US006655180B2

(12) United States Patent
Gokcebay et al.

(10) Patent No.: US 6,655,180 B2
(45) Date of Patent: Dec. 2, 2003

(54) LOCKER LOCK WITH ADJUSTABLE BOLT

(75) Inventors: Asil T. Gokcebay, Petaluma, CA (US); Yucel K. Keskin, Santa Clara, CA (US); Robert Kearns, Santa Clara, CA (US)

(73) Assignee: Security People, Inc., Petaluma, CA (US)

( * ) Notice: Subject to any disclaimer, the term of this patent is extended or adjusted under 35 U.S.C. 154(b) by 0 days.

(21) Appl. No.: 09/919,723

(22) Filed: Jul. 31, 2001

(65) Prior Publication Data

US 2003/0024288 A1 Feb. 6, 2003

(51) Int. Cl.[7] ..... E05B 41/00

(52) U.S. Cl. ..... 70/432; 70/461; 70/278.1; 340/5.2

(58) Field of Search ..... 340/825.31; 70/432, 70/434, 441, 461, 466, 462, 278.1; 292/337

(56) References Cited

U.S. PATENT DOCUMENTS

| | | | | | |
|---|---|---|---|---|---|
| 3,754,164 | A | | 8/1973 | Zorzy | 317/134 |
| 3,754,213 | A | | 8/1973 | Morroni et al. | 340/147 |
| 3,831,065 | A | | 8/1974 | Martin et al. | 317/134 |
| 3,878,511 | A | | 4/1975 | Wagner | 340/147 |
| 4,148,092 | A | * | 4/1979 | Martin | 70/153 X |
| 4,243,256 | A | | 1/1981 | Frydrych | 292/245 |
| 4,278,968 | A | * | 7/1981 | Arnett et al. | 340/545 |
| 4,495,540 | A | | 1/1985 | Remington et al. | 361/172 |
| 4,568,998 | A | * | 2/1986 | Kristy | 70/278 |
| 4,665,397 | A | | 5/1987 | Pinnow | 340/825.5 |
| 4,887,445 | A | * | 12/1989 | Beatty | 70/278 |
| 4,904,984 | A | * | 2/1990 | Gartner et al. | 70/333 R |
| 4,917,022 | A | * | 4/1990 | Ogasawara et al. | 70/278 |
| 4,957,315 | A | * | 9/1990 | Lin | 70/461 X |
| 4,967,305 | A | * | 10/1990 | Murrer et al. | 70/278 |
| 5,020,345 | A | * | 6/1991 | Gartner et al. | 70/278 X |
| 5,021,776 | A | * | 6/1991 | Anderson et al. | 340/825.31 |
| 5,033,282 | A | * | 7/1991 | Gartner et al. | 70/278 |
| 5,153,561 | A | | 10/1992 | Johnson | 340/571 |
| 5,223,829 | A | * | 6/1993 | Watabe | 340/825.31 |
| 5,321,963 | A | * | 6/1994 | Goldman | 70/278 |
| 5,410,301 | A | * | 4/1995 | Dawson et al. | 70/278 |
| 5,473,236 | A | * | 12/1995 | Frolov | 70/277 |
| 5,473,922 | A | * | 12/1995 | Bair et al. | 70/416 |
| 5,479,341 | A | * | 12/1995 | Pihl et al. | 340/542 X |
| 5,533,368 | A | * | 7/1996 | Eagan | 70/461 X |
| 5,617,082 | A | * | 4/1997 | Denison et al. | 340/825.31 |
| 5,697,689 | A | * | 12/1997 | Levine et al. | 362/26 |
| 5,886,644 | A | * | 3/1999 | Keskin et al. | 340/825.31 |
| 5,894,277 | A | * | 4/1999 | Keskin et al. | 340/825.31 |
| 5,896,765 | A | * | 4/1999 | Peyre et al. | 70/186 |
| 5,941,106 | A | * | 8/1999 | Williamson, Jr. et al. | 70/278.1 |
| 5,979,948 | A | * | 11/1999 | Aramburu | 70/461 X |
| 6,012,310 | A | * | 1/2000 | Hsiao | 70/278.2 |
| 6,098,433 | A | * | 8/2000 | Maniaci | 70/278.1 |
| 6,212,923 | B1 | * | 4/2001 | Clark | 70/416 |
| 6,220,066 | B1 | | 4/2001 | Häggström | 70/352 |
| 6,340,933 | B1 | * | 1/2002 | Chen et al. | 70/432 X |
| 6,441,735 | B1 | * | 8/2002 | Marko et al. | 70/432 X |
| 6,529,384 | B1 | | 3/2003 | Häggström | 361/759 |

OTHER PUBLICATIONS

Safe–o–mat card lock product sheet, 2 pages, http://www.safeomat.com/prod03.htm, printed May 13, 2003.

* cited by examiner

*Primary Examiner*—Suzanne Dinp Barrett
(74) *Attorney, Agent, or Firm*—Thomas M. Freiburger

(57) ABSTRACT

An electronic lock device includes provision for setting different bolt or latch extension lengths, to accommodate different door lock situations. In addition, the bolt or latch itself preferably is interchangeable for bolts or latches of different sizes or configurations, including switching a latch for a bolt or vice versa. The bolt or latch extension can be settable via a keypad or ibutton. In the preferred embodiments the lock units include a D.C. geared micromotor, which is also included in other electronic lock units disclosed.

4 Claims, 22 Drawing Sheets

BOLT 5/8" PROTRUSION

BOLT 3/8" PROTRUSION

BOLT 1/4" PROTRUSION

BOLT 0" PROTRUSION

BOLT 3/8" PROTRUSION

BOLT 0" PROTRUSION

LOCKER LOCK WITH ADJUSTABLE BOLT

BACKGROUND OF THE INVENTION

This invention is concerned with security of lockers, safes, desks, cabinets or other such storage devices assigned for temporary or long-term use. In particular, the invention relates to a lock operated by an electronic identification means for such storage situations.

Electric locks are well known. For example, hotel safes for temporary use by guests have included digital locks with keypad and other electronic identification means to provide access to the hotel guest. In some cases, the guest is able to select his/her own combination for the lock and in others the guest is issued a pre-selected number or some electronic identification means used as the "key" for the lock device.

The following U.S. Pat. Nos. are believed to have some relevance to this invention: 5,886,644 and 5,894,277.

There has been a need for an electro mechanical lock operated by an electronic identification means of relatively inexpensive construction with more versatility as to use on various standard designs of doors, modularity as to assembly, opposite hand use and bolt throw length, easy programmability and convenience and simplicity to the user, including adaptability and ease of use for persons with disabilities.

SUMMARY OF THE INVENTION

A variety of locks for lockers, safes and cabinets exist. Some are mechanical and work with keys or combination dials; some are electronic and operate with use of keypads or other electronic identification data. However, no single locking device has been able to address the problem of adaptability to various door types and door preparations. Metal lockers manufactured in the United States typically are equipped with a vertical locking bar, which locks the door unit to the frame in two or three points. The lock mechanism blocks this vertical locking bar. Alternatively, the locker employs a single point latch mechanism. In both cases the majority of lockers utilize a three-hole door preparation and a locking position that is standard. However, the bolt or latch length required for the three point locking bar is different from that required for a single point latch, making it difficult to use a single locking device which would fit for both applications.

Most wood doors are locked by small cam lock devices, which operate with the turning of the key and flipping of the cam mechanism. Again with the wood doors there are different locking points required for different doors. A locking mechanism shown by the instant invention provides a locking mechanism to address numerous door types and preparations as well as numerous functionalities.

An important object of the invention is to provide an electro mechanical lock that fits to various standard door preparations without any modification, providing instant retrofit capability to various types of doors, and including programmable bolt extension length that is adjustable to the particular locking application. Another object of the invention is to provide a locking mechanism that is easy to use by people with disabilities. Yet another objection of the invention is to allow numerous functionalities to cover different usages. A further object is to provide improved bolt drive systems for the lock units described in U.S. Pat. Nos. 5,886,644 and 5,894,277, and the disclosure of those patents are incorporated herein by reference.

These and other objects, advantages and features of the invention will be apparent from the following description of a preferred embodiment, considered along with the accompanying drawings.

DESCRIPTION OF PREFERRED EMBODIMENTS

Figure 1:
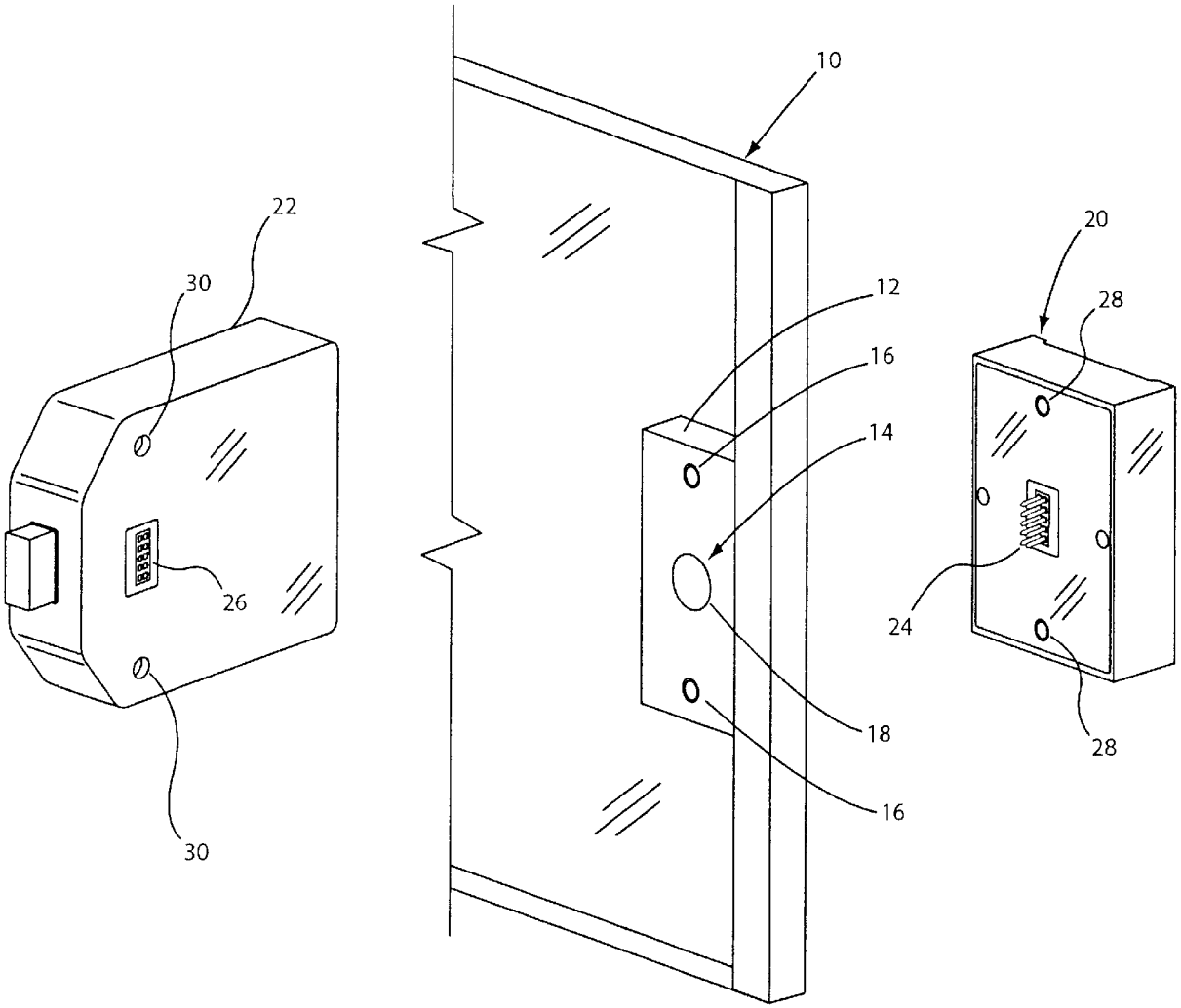
FIG. 1 is an exploded view in perspective, indicating the assembly of two sub units or housings of the electronic lock through a metal locker door.

FIG. 1 shows a portion of a locker door or cabinet door 10 which, in this case, has a recessed lock mounting 12, recessed inwardly in the metal door. The illustrated door has a standard three-hole door prep identified generally as 14, with two opposed mounting holes 16 at top and bottom and a larger center hole 18. The hole 18 conventionally was intended to receive the dial shaft of a built-in combination lock or a key hole of the key operated built-in combination lock.

The lock device of this invention includes an outer housing 20 and an inner housing 22, shown separated and on either side of the door 10, as they are assembled by connecting them with electrical pin 24 and socket 26 connectors through the recess 14 of the door, in a sandwiched construction. All this is as described in U.S. Pat. No. 5,894,277, assigned to the assignee of this invention and incorporated herein by reference. As explained in that patent, fastening bores 28 at the back side of the outer housing 20 and fastening holes 30 in the inner housing 22 are lined up with the upper and lower locker door holes 16 to receive fasteners to secure the assembly together. Preferably the bores 28 on the outer housing are tapped, and the inner housing holes 30 are through-holes so that a pair of machine screws can secure the two units together and to the door recess 12. In another embodiment, the front unit 20 may be fitted with threaded posts at the location 28 which will go through the holes 16 and 30 and fastened with nuts behind new unit 22 sandwiching the mounting plate 12.

Figure 2:
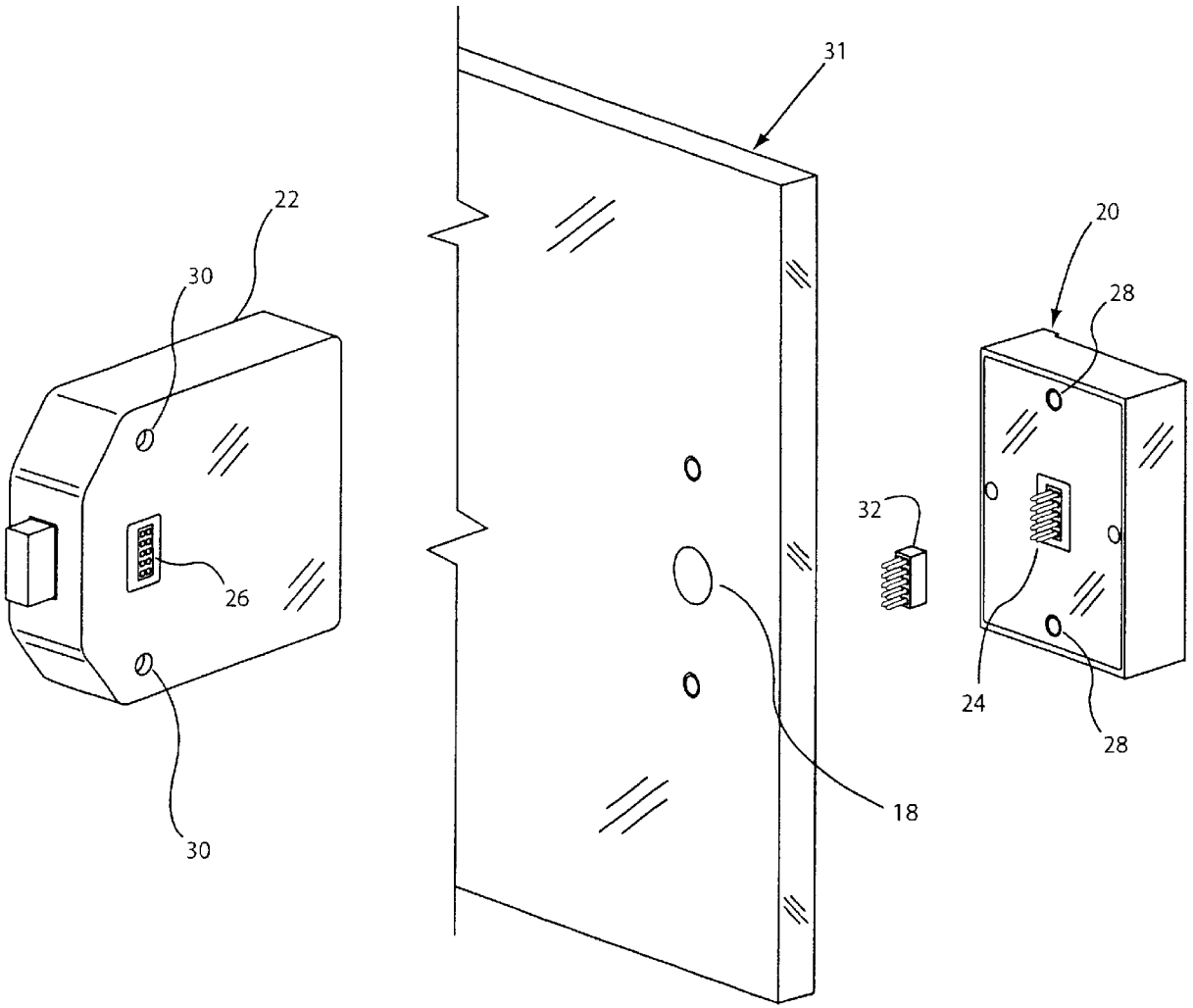
FIG. 2 is a view similar to FIG. 1, but indicating the inner and outer housings as being assembled through a wood door, and showing a connection extender.

FIG. 2 indicates that the same inner and outer housings 22 and 20 can be used on a wood door 31, which has a much larger thickness to be penetrated with the sandwiched assembly. This can be accomplished with a connection extender 32 as shown.

It should also be understood that the invention described herein can be formed as a single unit, rather than inner and outer housings, with that single unit mounted entirely on the inside of the door, whether the door be metal or wood.

Figure 3:
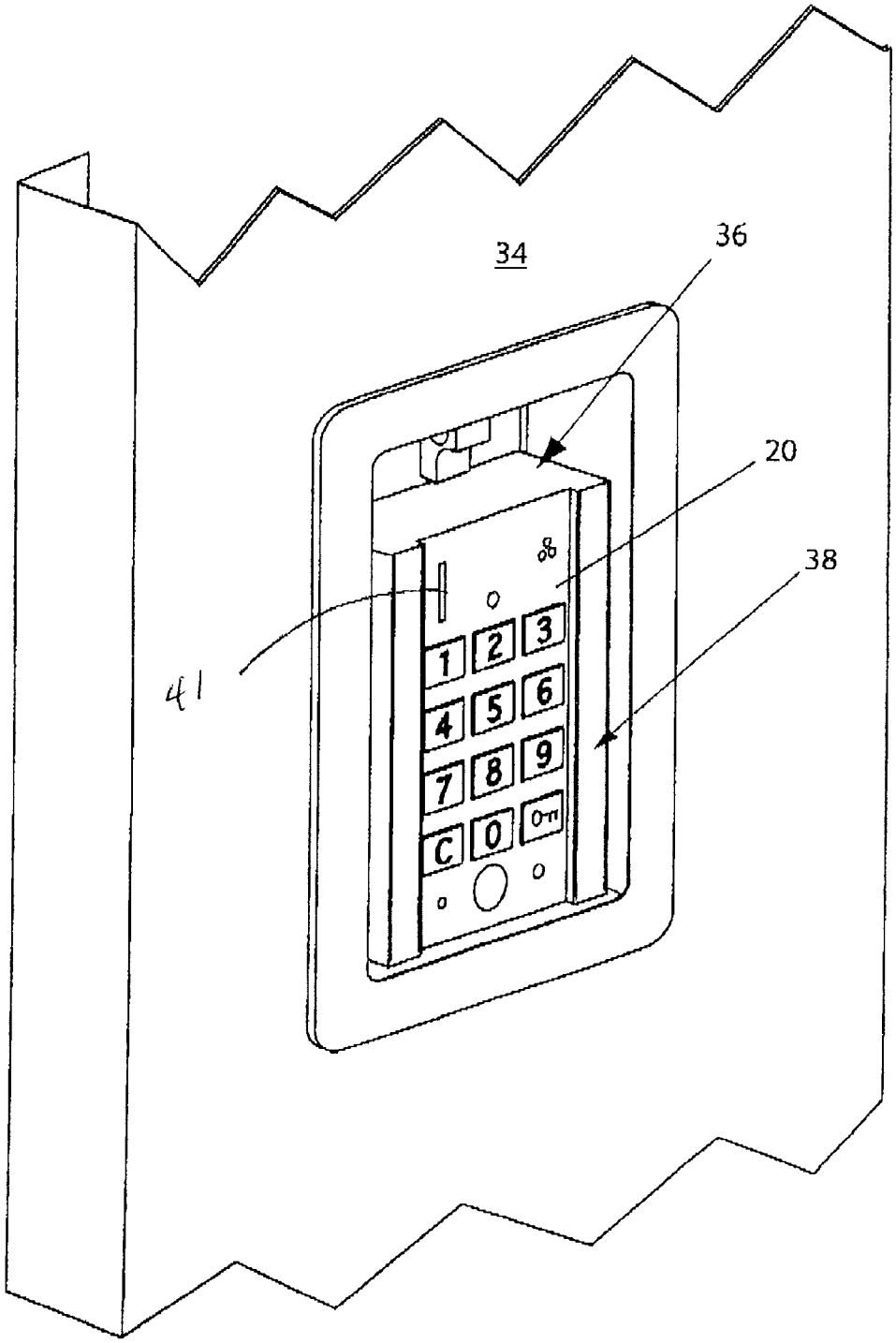
FIG. 3 is a perspective view showing a metal locker door front with a lock recess fitted with a keypad unit in an embodiment of the electronic lock.
Figure 4:
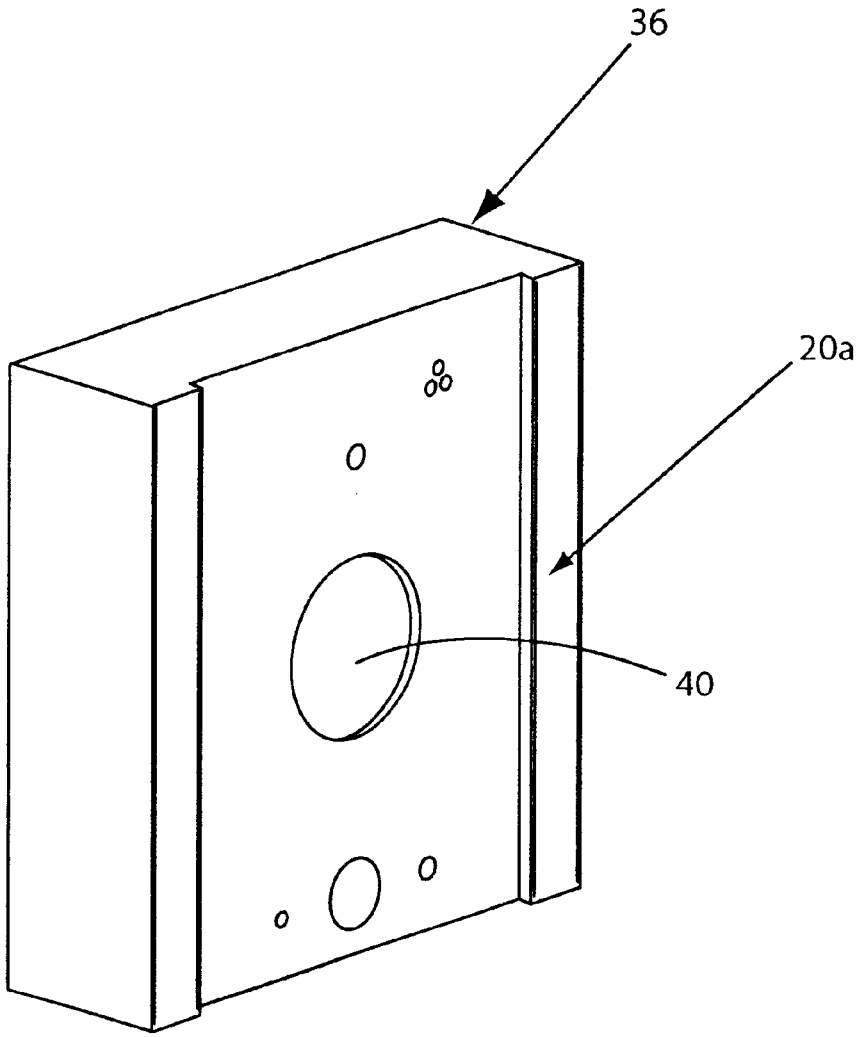
FIG. 4 is a perspective view showing a front unit of an electronic lock, with an button contact rather than a keypad.

FIG. 3 shows an example of a locker front 34, which could be the front of the locker door 10 shown in FIG. 1, with an electronic door access device 36 which can include the front housing 20 shown in FIG. 1. In this case the front housing 20 has a keypad 38, but, as shown in FIG. 4, the front housing 20*a* can have an ibutton contact 40, which provides for electronic access by contact with the user's hand-held ibutton as explained in U.S. Pat. No. 5,886,644 assigned to the assignee of this invention and incorporated by reference herein. The access device or electronic access means can also include other types of readers such as proximity devices, transponders, radio frequency or infrared readers which can communicate the user's I.D. or code remotely to the housing 20*a*. The item 40 in FIG. 4 can represent a reader or receiving device for other identification technologies mentioned above such as proximity cards or infrared devices. Other features on the face of the ibutton-receiving outer housing 20*a* are explained in the '644 patent.

Again referring to FIG. 3, a key slot 41 is included in the electronic access device 36 in one preferred embodiment. This is for access by a manager. In a preferred embodiment the manager possesses a small key with a small blade which actually comprises a circuit board with traces, connected to an ibutton. This key is used for manager functions, such as opening the locker without the need for entry of a manager code on the keypad. The advantages are that the user does not see the manager code, which could be misused; a unique manager key code can be assigned and deleted when needed (such as if a key is lost); and each manager holding a key can be uniquely identified, such as if an audit trail feature is included.

The electronic locking device of the invention can be used on lockers equipped with a vertical locking bar to lock the door unit to the frame at two or three locking points, or it can be used on lockers or cabinet doors with a single point latch mechanism or it can also be used on locker or cabinet doors with other locking arrangements wherein the locking mechanism is designed to be blocked by the bolt or latch unit of a built-in locker lock.

Figure 5:
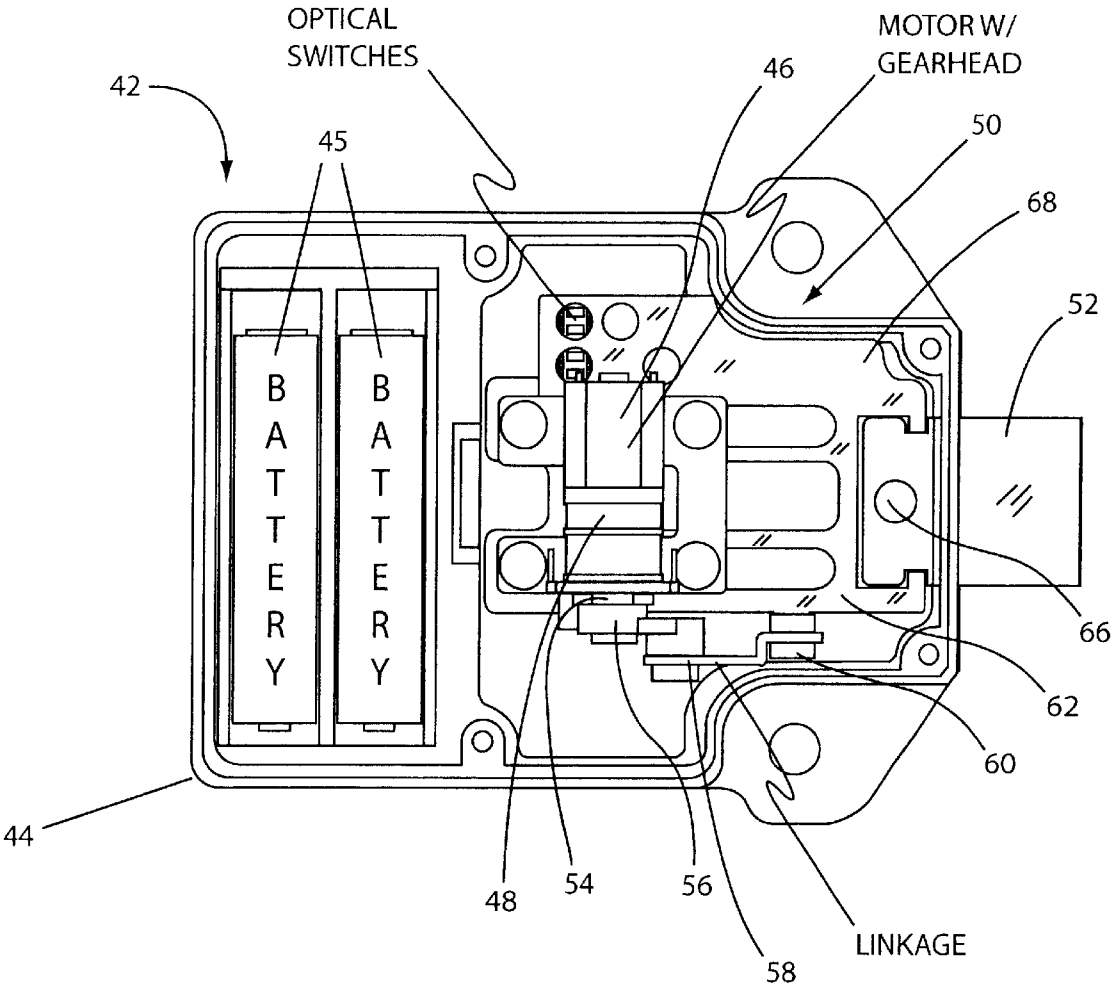
FIG. 5 is an elevation view showing the interior of an electronic locking device with a bolt unit of the invention.
Figure 6:
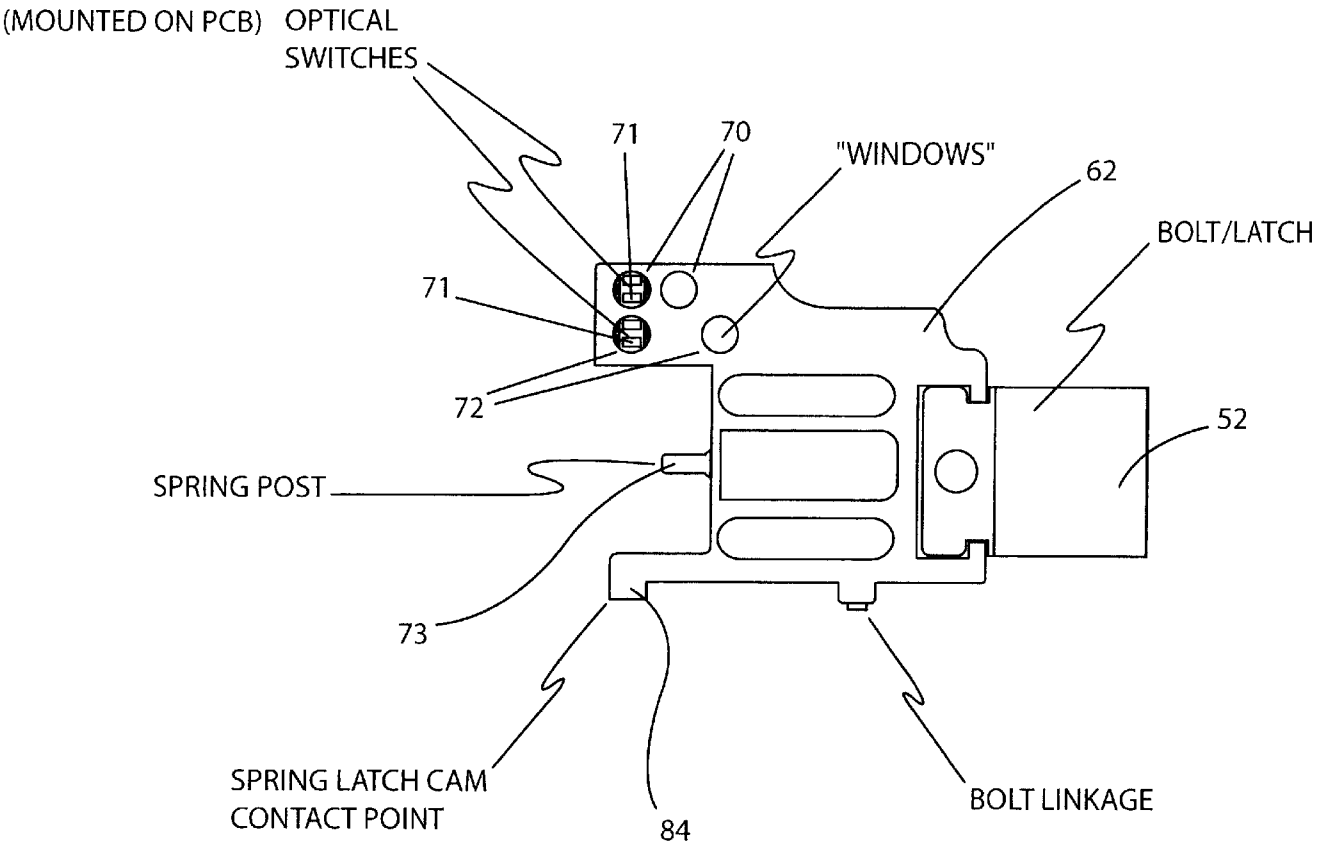
FIG. 6 is a detailed view showing a bolt carrier and linkage and bolt which form a part of the assembly shown in FIG. 5.
Figure 7:
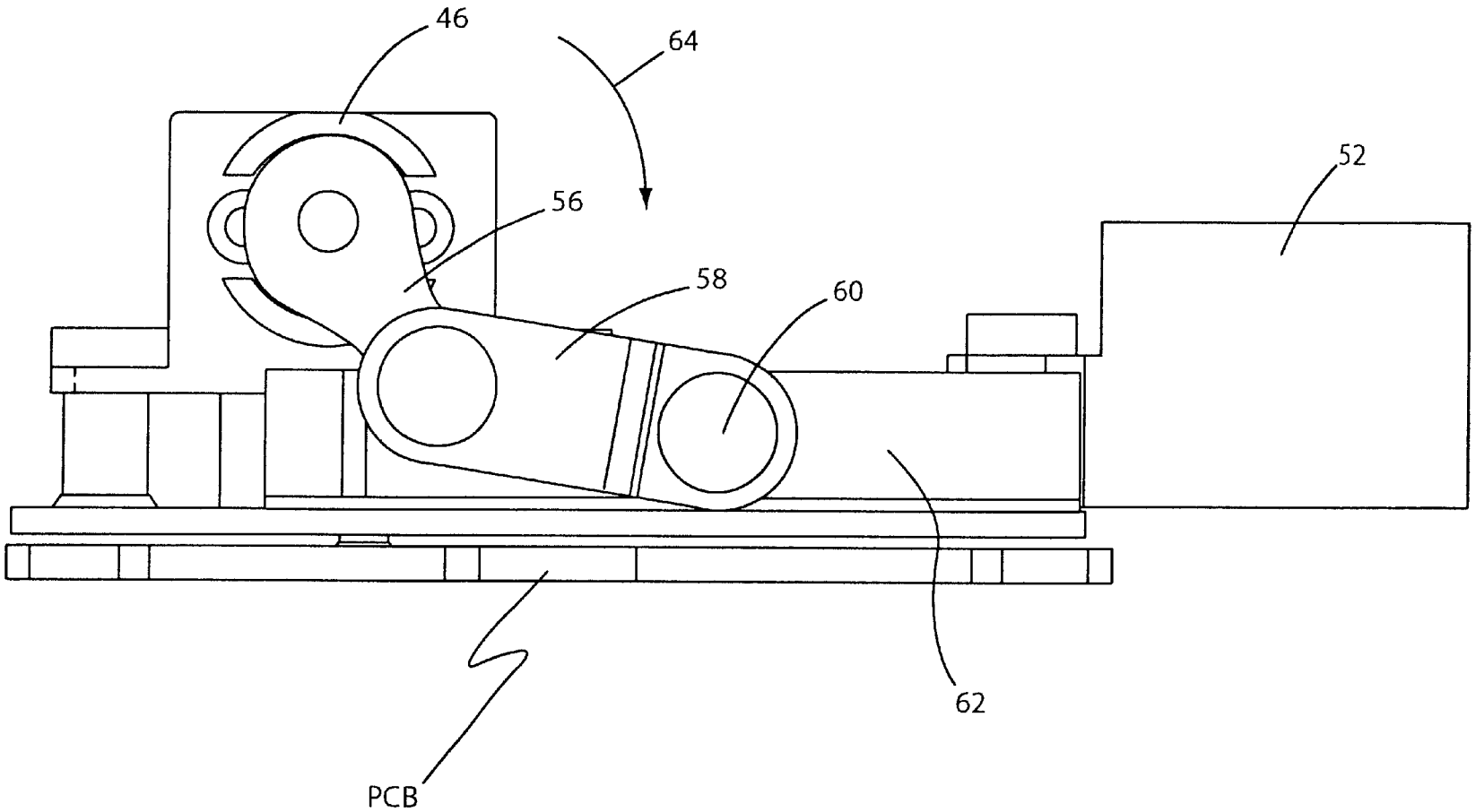
FIG. 7 is a schematic side view showing a portion of the assembly of FIG. 5 and indicating the action of a motor driving a bolt linkage and bolt of the lock.

FIG. 5 shows the interior of an electronic locking device 42 of the invention. This could be the inner unit 22 shown in FIG. 1 or FIG. 2, or it could be a self-contained locking unit which is mounted from only one side of the door. FIGS. 5, 6 and 7 show details of this mechanism, which, in one preferred embodiment, allows adjustment of the length of bolt travel. In FIG. 5 the unit is shown with a housing 44, batteries 45 located in a rear portion of the housing, a micromotor 46 which includes a gear head 48 (together referred to as a DC geared micromotor), and a mechanism 50 for transferring motion from the motor and gear head to a lock bolt 52 shown protruding from the housing. This mechanism includes an output shaft 54 from the gear head which turns a linkage arm 56. This linkage arm is pivotally connected to another linkage arm 58, which has an opposite end connected at a pivot point 60 to the bolt slider linkage or carrier plate 62 engaged to the bolt 52 as shown. Although the bolt and carrier are conveniently formed as separate pieces, the bolt could be one single component comprising an integration of the two, if desired, and this should be understood in the claims.

FIG. 7 shows schematically and in a partial side view the action of the motor in retracting or extending the bolt 52. As can be seen, the motor and gear head rotate the first linkage arm 56 in a clockwise direction as shown by the arrow 64 to retract the linkage arm 58 and the bolt carrier 62, which retracts the bolt 52. When the bolt is to be extended, the first linkage arm 56 pivots counterclockwise toward the position shown, pushing the second arm 58 outwardly to the position shown, and thus extending the bolt carrier and bolt.

As can be seen in FIGS. 5 and 6, the bolt 52 and bolt carrier are modular, and a different bolt 52, shorter or longer, can be substituted merely via an access screw 66 and by lifting the bolt out from a pair of gripping flanges 68, with the housing open. Also as seen in FIG. 6, the bolt carrier unit can be used for attaching a bolt or a spring latch, in this case a spring is attached to the spring post 73.

In addition, as noted above, the length of throw or travel of the bolt 52 (regardless of which modular bolt is used) can be adjusted by the mechanism according to the invention. This is accomplished electronically, using feedback from a sensor or sensors 71 as to the bolt carrier position. The signals are fed to a micro-processor on board the unit, which provides for powering the motor in the appropriate direction and stopping the motor when the latch has reached the desired end of travel.

Figure 8:
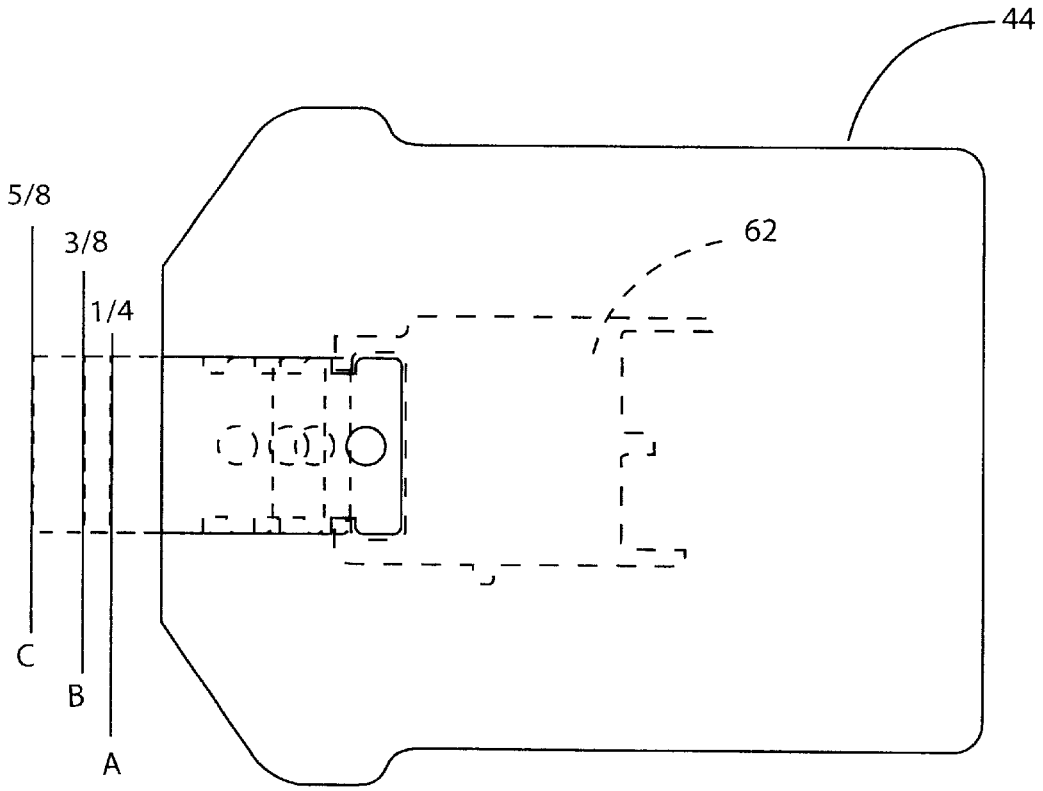
FIG. 8 is a schematic view indicating different settable positions of an adjustable throw bolt of the assembly shown in FIGS. 5–7.

FIG. 8 schematically shows the various settings for bolt throw with the lock of the invention. The lock housing is indicated at 44, with the bolt carrier indicated at 62. The bolt extension is shown at three different lengths A, B and C, as alternatives. These might become, for example, ¼ inch of throw, ⅜ inch of throw, and ⅝ inch of throw although these distances can be selected as desired.

The way in which this is achieved is preferably by using optical sensing. In FIG. 6 the bolt slider linkage or carrier 62 is shown without the housing and remaining components, and the carrier is shown as having a series of holes or "windows" 70 and 72. The row of holes 70 is lined up for reading by one optical sensor 71, while the row of holes 72 is lined up for reading by a second optical sensor 71. Advantageously, these sensors can be of the type which include a light source projecting toward the bolt carrier, as from below or behind the bolt carrier as seen in FIG. 6. If the sensor sees no reflected light, a hole is present. If the sensor does detect reflected light, a hole is not precisely at the location of the sensor. This is true of both rows of holes. The holes and sensors are so located that various settings can be achieved, and the user or person who programs the lock for the desired settings will select the proper position indicating desired full retraction and the proper position indicating desired full extension. Alternatively, the mechanism can be simpler and allow for only adjustment of the fully extended position, with the retracted position always being the same. In any event, the two sensors 71 act together and feed signals to the microprocessor which determines the position of the bolt at any given time, and which shuts off power to the motor 46 when the desired position of extension (or retraction) is reached. Stoppage of the bolt travel is almost instantaneous when the motor power is cut off. The two rows of holes are preferred, so that two signals are fed to the microprocessor at each position, and the microprocessor can then determine exactly where the bolt and bolt carrier are located. Otherwise, the microprocessor would have to perform some type of counting and memory function to know which particular hole is over the sensor, which is possible, but not preferred.

Figure 9:
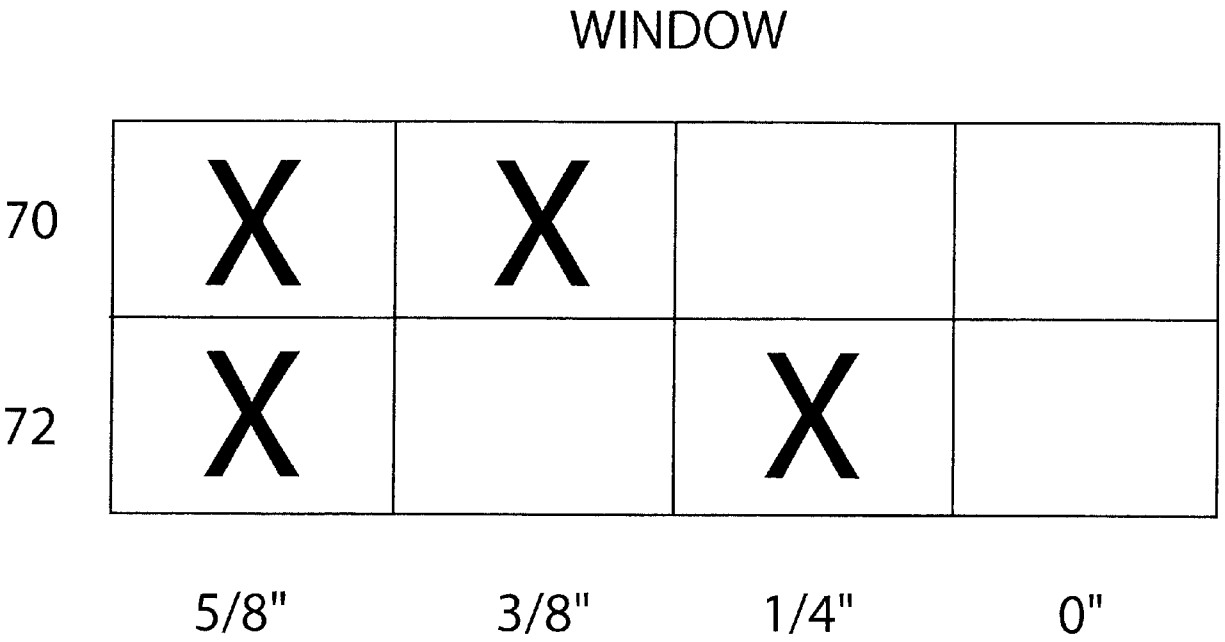
FIG. 9 is a diagram to explain a preferred embodiment of position-sensored logic associated with the device of FIGS. 5–8.

FIG. 9 indicates a form of simple logic for the system with two rows of holes or "windows" 70 and 72. The holes and sensors are set up so that the signal to the microprocessor is either "no/no" (e.g., ¼-inch setting), "no/yes" (e.g., ⅜-inch setting) or "yes/yes" (e.g., ⅝-inch setting).

Other forms of position sensors can be used for the extended and retracted positions of the latch, such as an encoder connected to a rotational component such as the motor 46 or the output shaft 54 or the gear head 48 and connected to the microprocessor, or a simple limit switch, or a pair of limit switches for beginning and end of bolt travel, with one or more flags to trip the limit switches, and again with signals sent to the microprocessor. The limit switches could be adjustable by purely mechanical adjustment so as to set the retracted and extended positions of the bolt, or the flag positions could be adjustable, or the limit switches could have multiple trip positions sending different signals to the microprocessor.

It should be understood that a wide variety of door situations can be addressed by the apparatus of the invention, by use of the replaceable bolt, interchangeable with bolts of different lengths, in combination with the adjustable, settable throw of the bolt mechanism. Many different backset situations can be accommodated, as well as other conditions such as bolt thickness in various doors or lockers, cabinets, etc.

Figure 10:
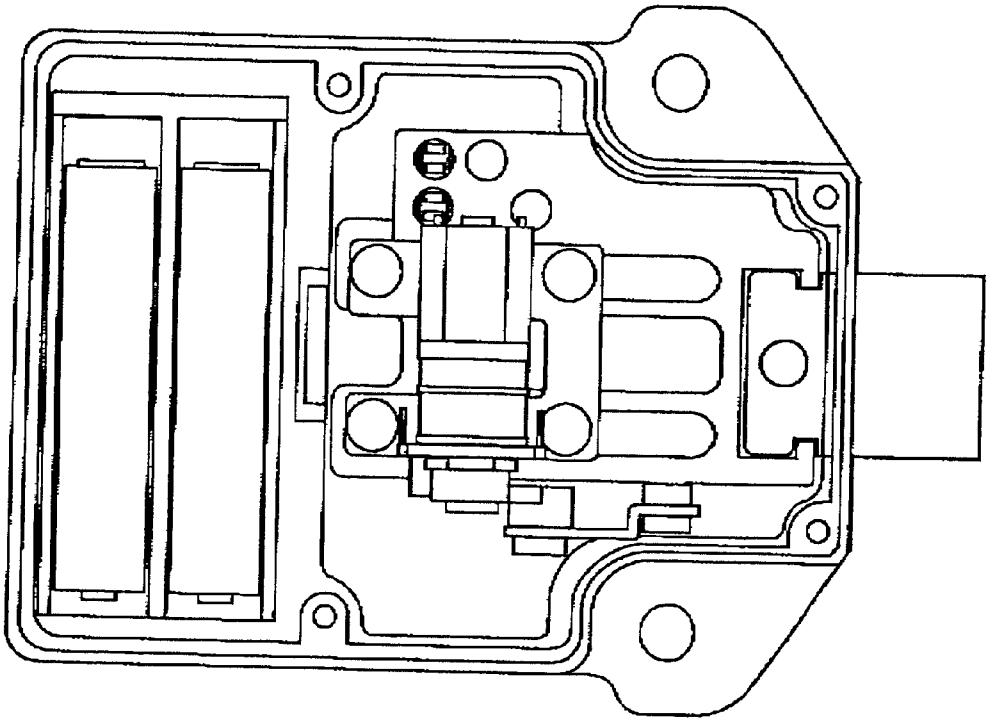
FIG. 10 is an elevation view showing the interior of an electronic locking device of the invention with a bolt unit set to extend to one protrusion length, e.g., ⅝".
Figure 10A:
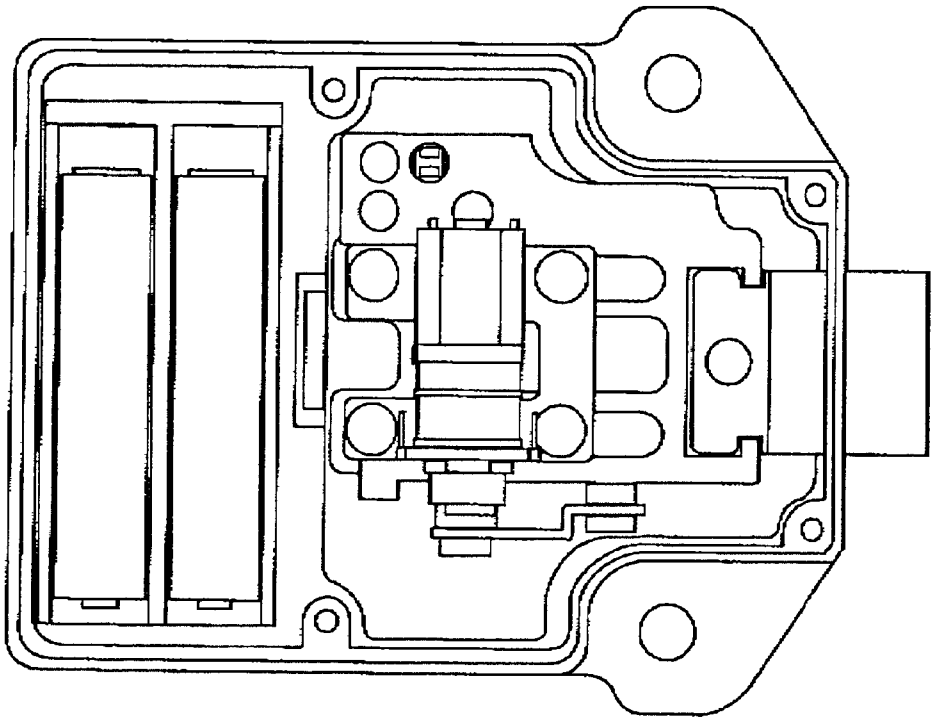
FIG. 10A is an elevation view showing the interior of an electronic locking device of the invention with a bolt unit set to extend to another protrusion, e.g., ⅜".
Figure 10B:
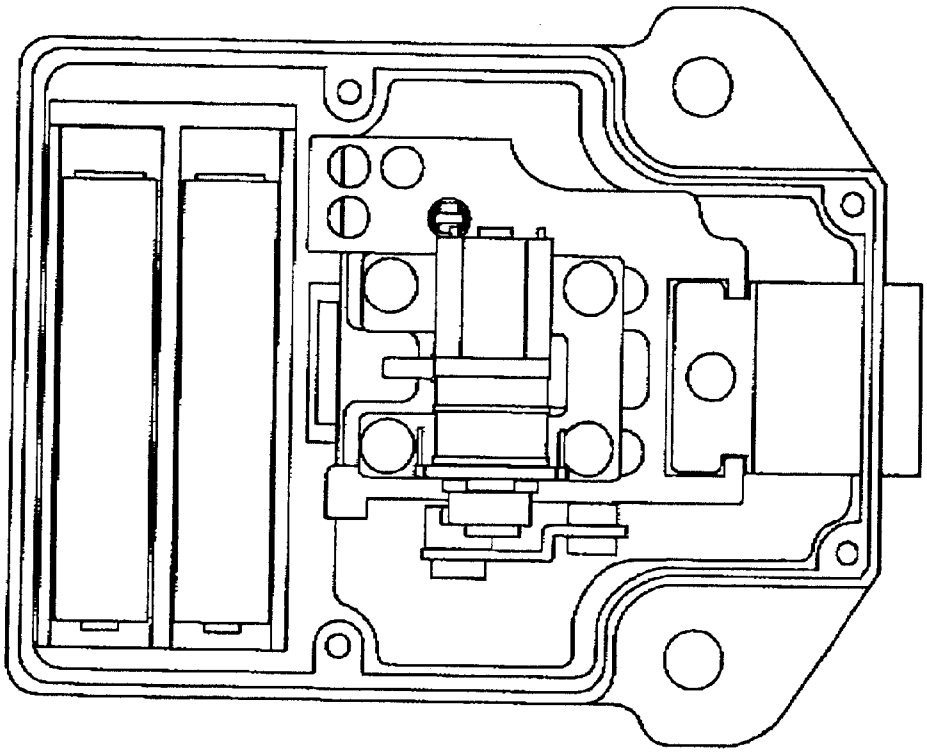
FIG. 10B is an elevation view showing the interior of an electronic locking device of the invention with a bolt unit set to extend to another protrusion, e.g, ¼".
Figure 10C:
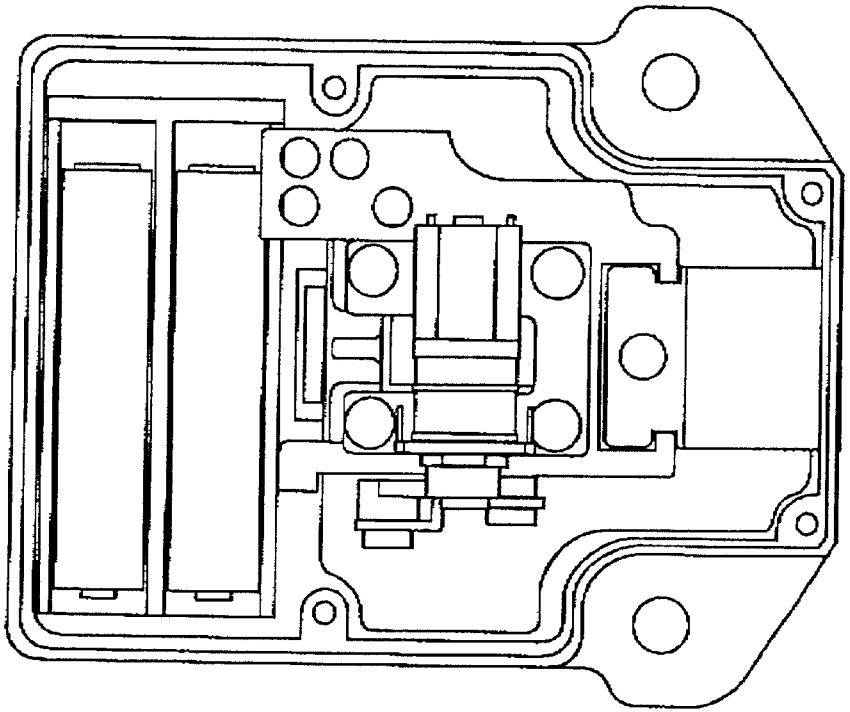
FIG. 10C is an elevation view showing the interior of an electronic locking device of the invention with the bolt in the retracted position.

FIGS. 10–10C illustrate the sensor positions and related bolt throws of the lock device of the invention.

Figure 11:
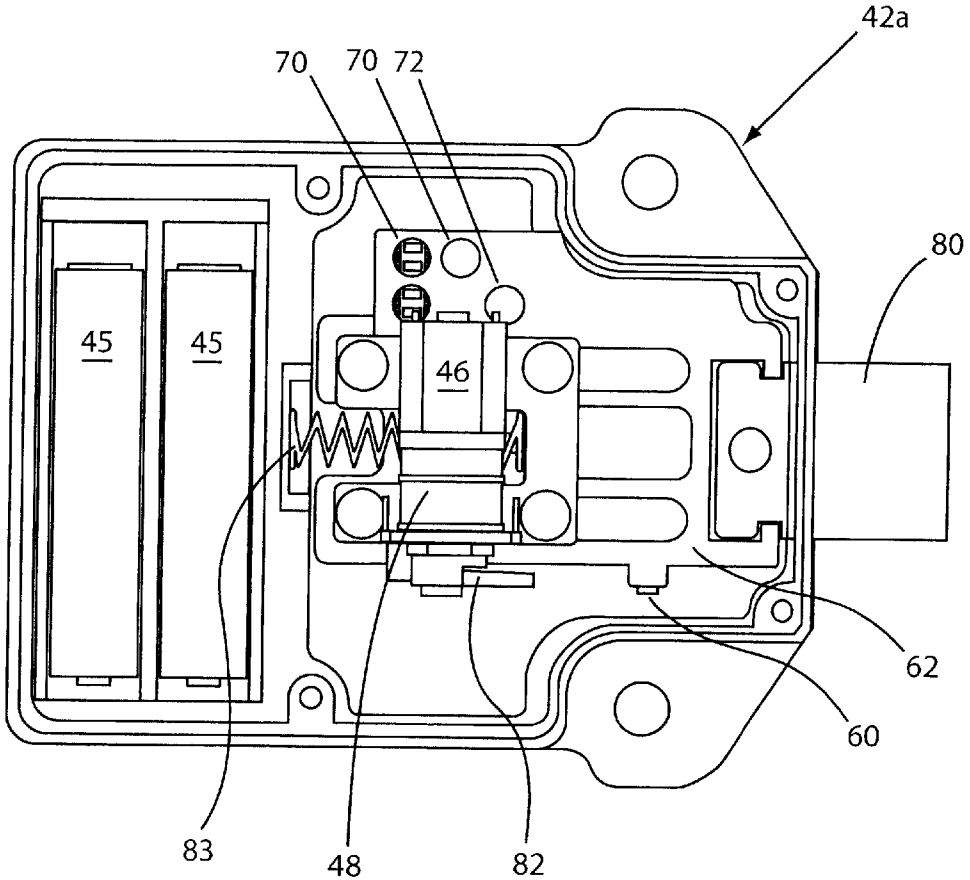
FIG. 11 is an elevation view showing the interior of an electronic locking device with a spring latch unit of the invention.
Figure 11A:
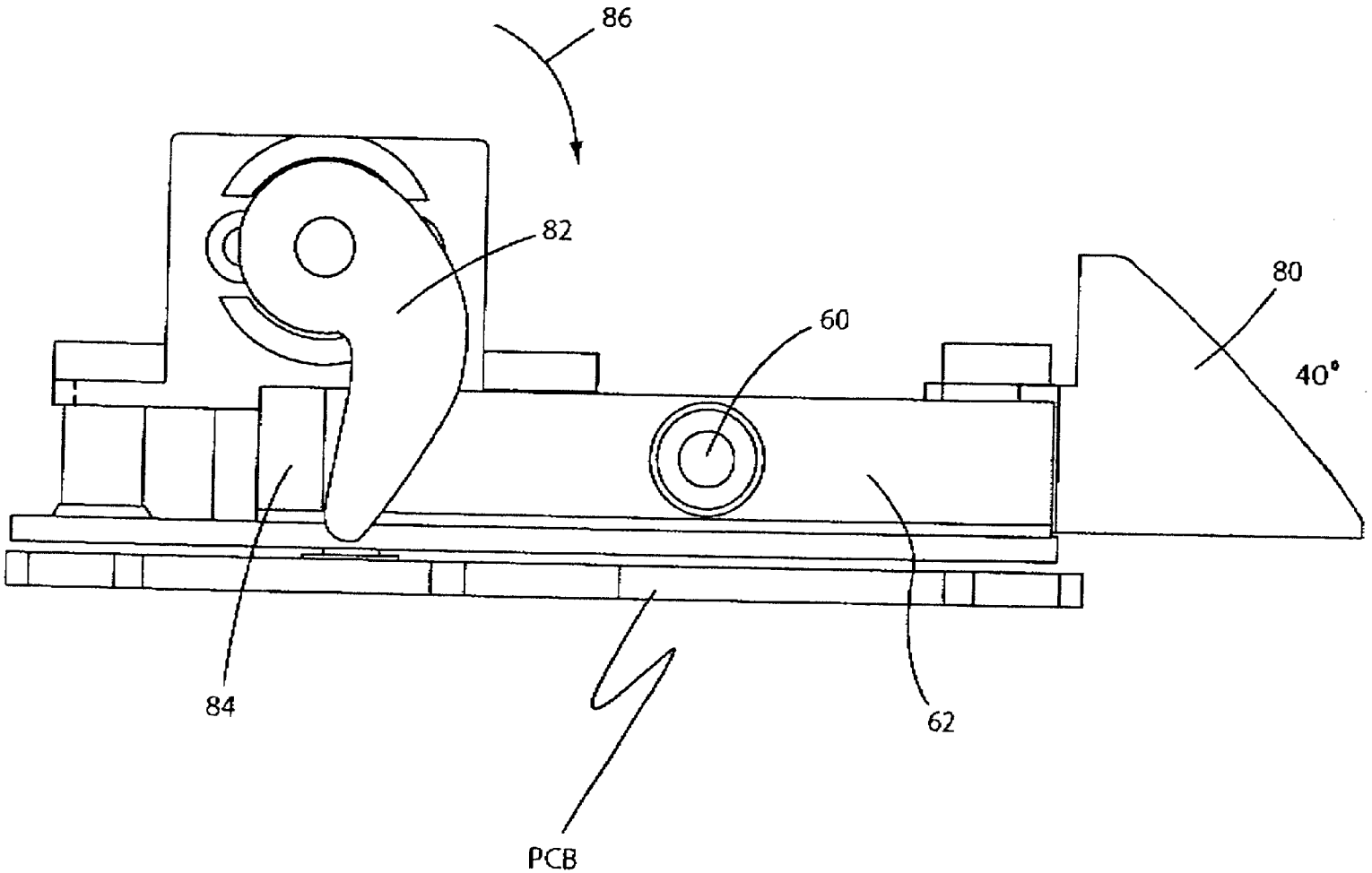
FIG. 11A is a schematic side view showing a portion of the assembly of FIG. 11 and indicating the action of a motor driving the spring loaded latch unit with the movement of a cam unit.

FIGS. 11 and 11A are elevation and side views illustrating the same lock device of the invention, but with a spring latch rather than a bolt. FIGS. 11 and 11A show a spring latch 80, engaged with a carrier or slider linkage 62 which can be essentially the same as the slider linkage 62 which carries a bolt in FIGS. 5–6. Here, instead of being engaged by a linkage arm at the pivot point 60 as in the earlier embodiment, the slider linkage 62 is biased toward the extended position shown by a spring 83 but is retracted by the DC micromotor (motor 46 and gear head 48) using a cam or lever 82 that engages a tab or flange 84 on the slider linkage 62 as shown particularly in FIG. 11A. The lever 82 retracts the carrier and spring latch by motion in the clockwise direction as seen in FIG. 11A, as indicated by the arrow 86. When the latch is to be extended, the lever 82 is rotated in the opposite direction (counterclockwise in FIG. 11A), so as to allow the carrier 62 and latch 80 to extend back outwardly under the influence of the spring 83. FIG. 11 shows that the lock unit 42*a* can include rows of "windows" 70 and 72 as in the bolt form of the invention, with sensors 71 as shown to allow the full retracted position and full extended position to be adjusted by programming as desired.

Again, as in the bolt embodiment, the lock unit 42*a* has provision for replaceable latches 80, so that a latch of proper length can be selected to accommodate different situations of doors.

Figure 12:
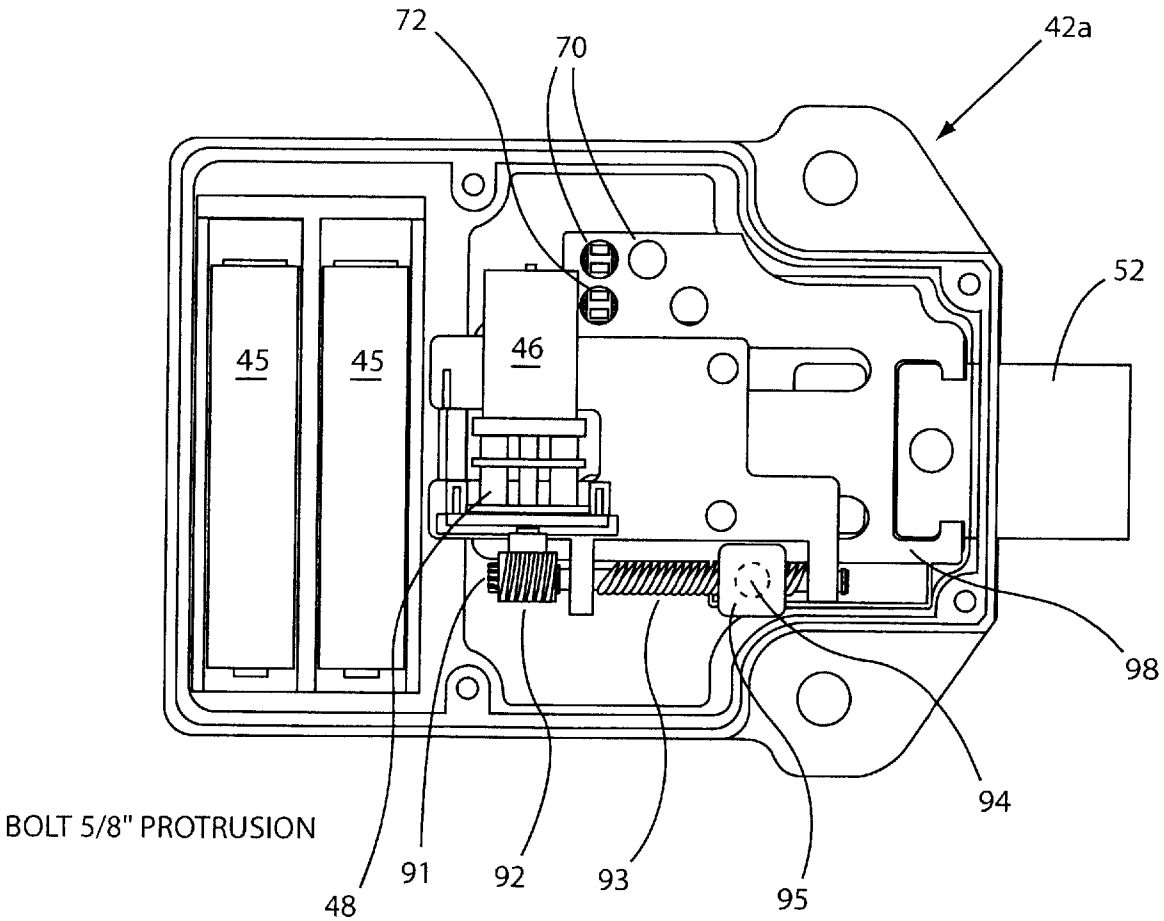
FIG. 12 is an elevation view showing the interior of an electronic locking device of the invention with a bolt unit employing a screw drive mechanism and shown with the longest protrusion, e.g., ⅝".
Figure 12A:
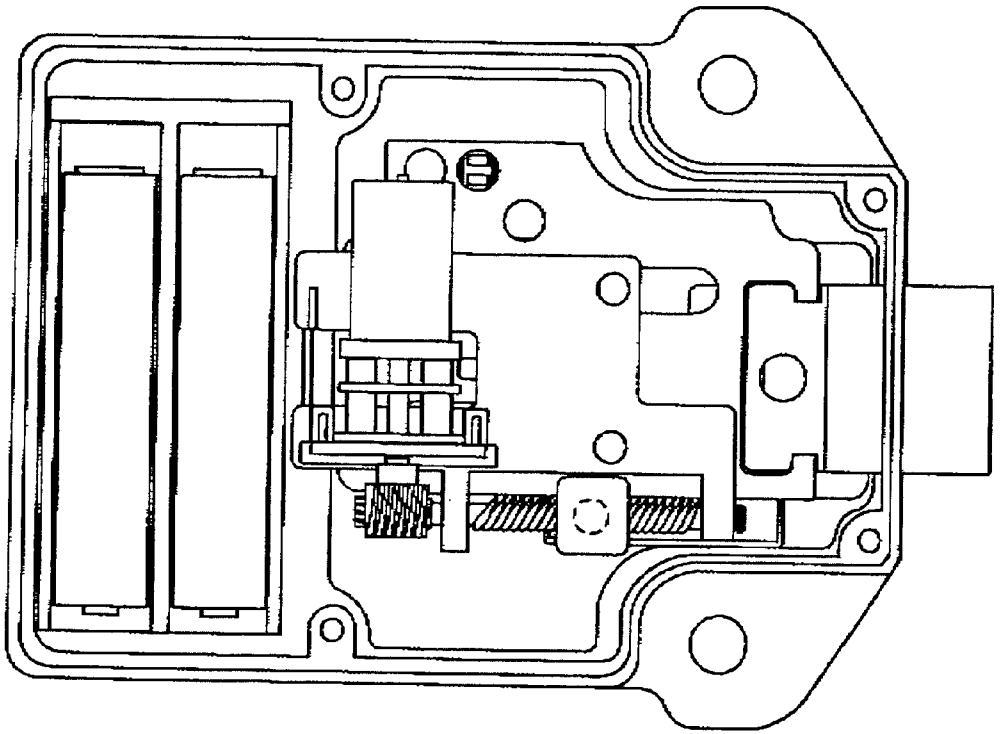
FIG. 12A is an elevation view showing the interior of an electronic locking device of the invention with a bolt unit employing a screw drive mechanism and shown with ⅜" protrusion, for example.
Figure 12B:
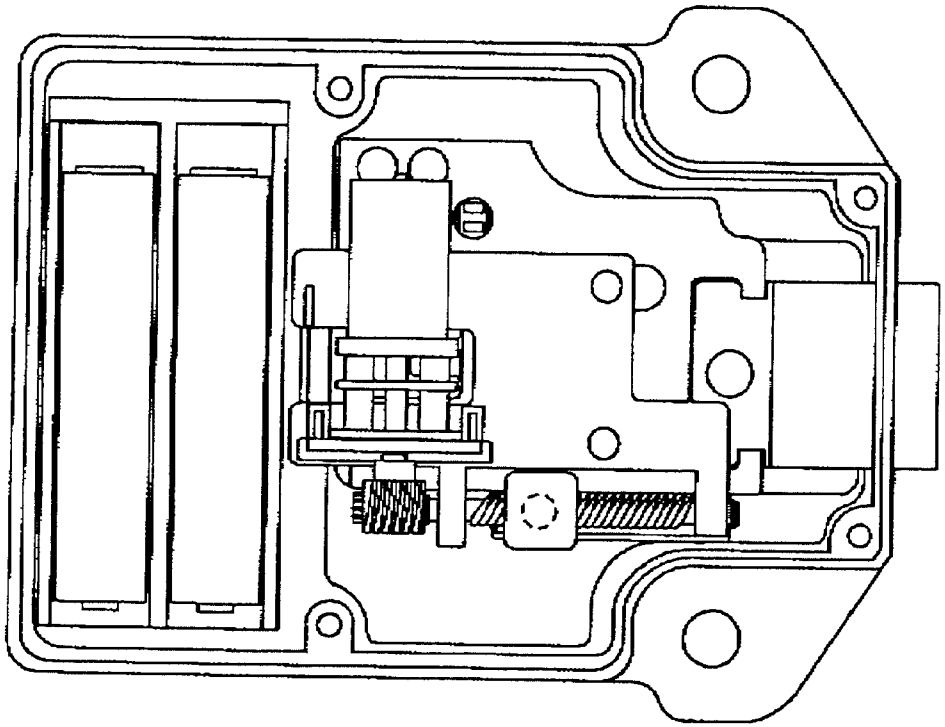
FIG. 12B is an elevation view showing the interior of an electronic locking device of the invention with a bolt unit employing a screw drive mechanism and shown with ¼" protrusion, for example.
Figure 12C:
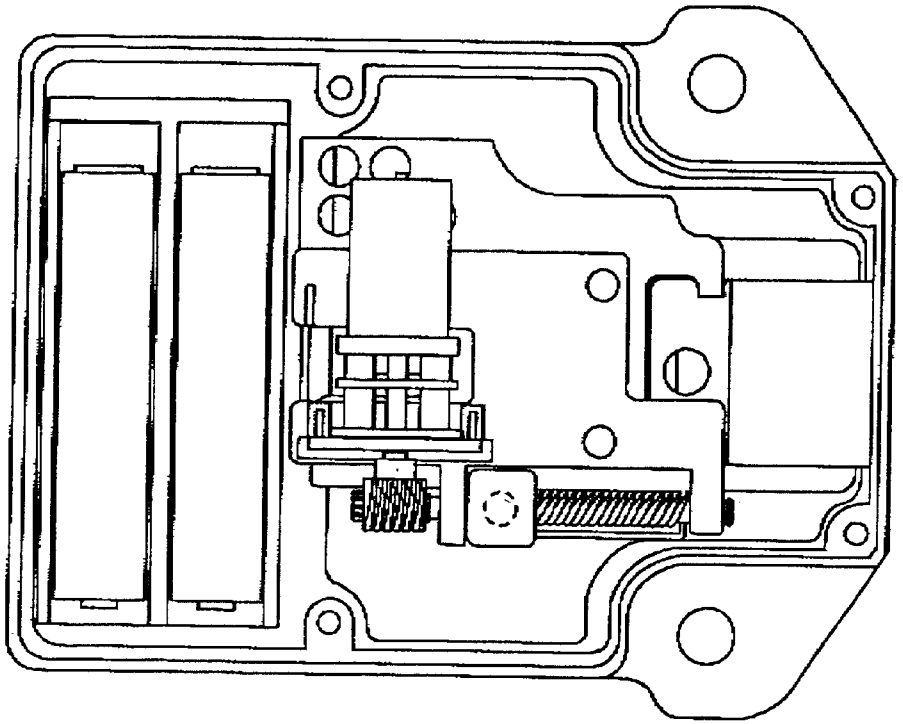
FIG. 12C is an elevation view showing the interior of an electronic locking device of the invention with a bolt unit employing a screw drive mechanism and shown in retracted position.

FIG. 12 shows the same lock unit shown in FIGS. 5 and 10 but with a different drive mechanism, which achieves essentially the same result. In this case a gear 91 which may be a helical gear attached to the motor gear head 48 turns a gear 92 which may be another helical gear on a shaft at right angles to the output of the gear head. The gear 92 and a continuous screw 93 are part of the screw-drive unit and when the screw 93 turns a travel nut 95 which is attached by a small mounting screw or other fastener 94 (shown in dashed lines) to a bolt carrier plate or slider linkage 98, it rides back and forth on the drive screw 93 creating the necessary movement for the bolt 52. FIGS. 12–12C show different bolt protrusions and relative sensor configurations as discussed earlier.

Figure 13:
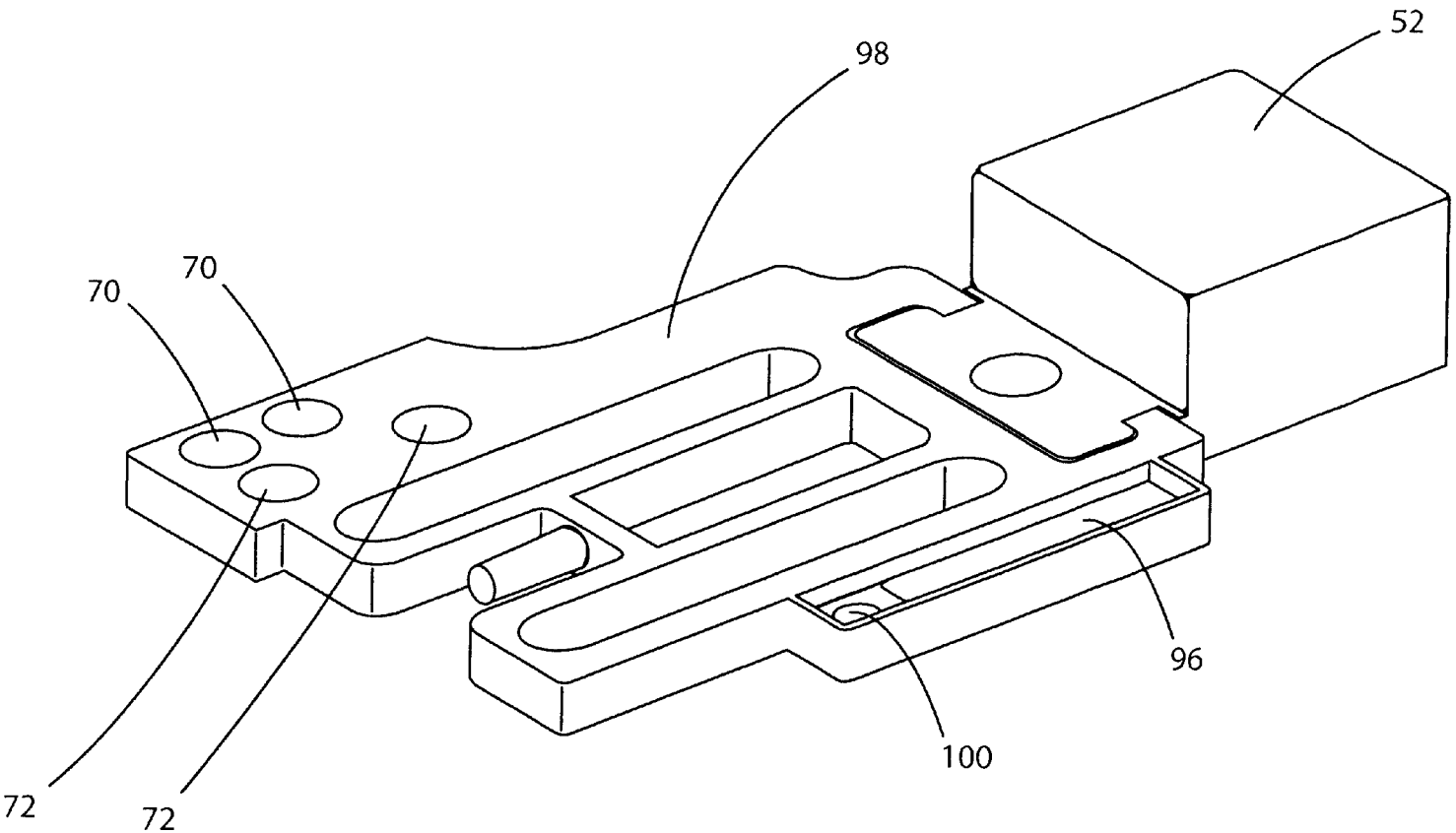
FIG. 13 is an isometric view of the screw drive systems bolt carrier unit used with a bolt.
Figure 13A:
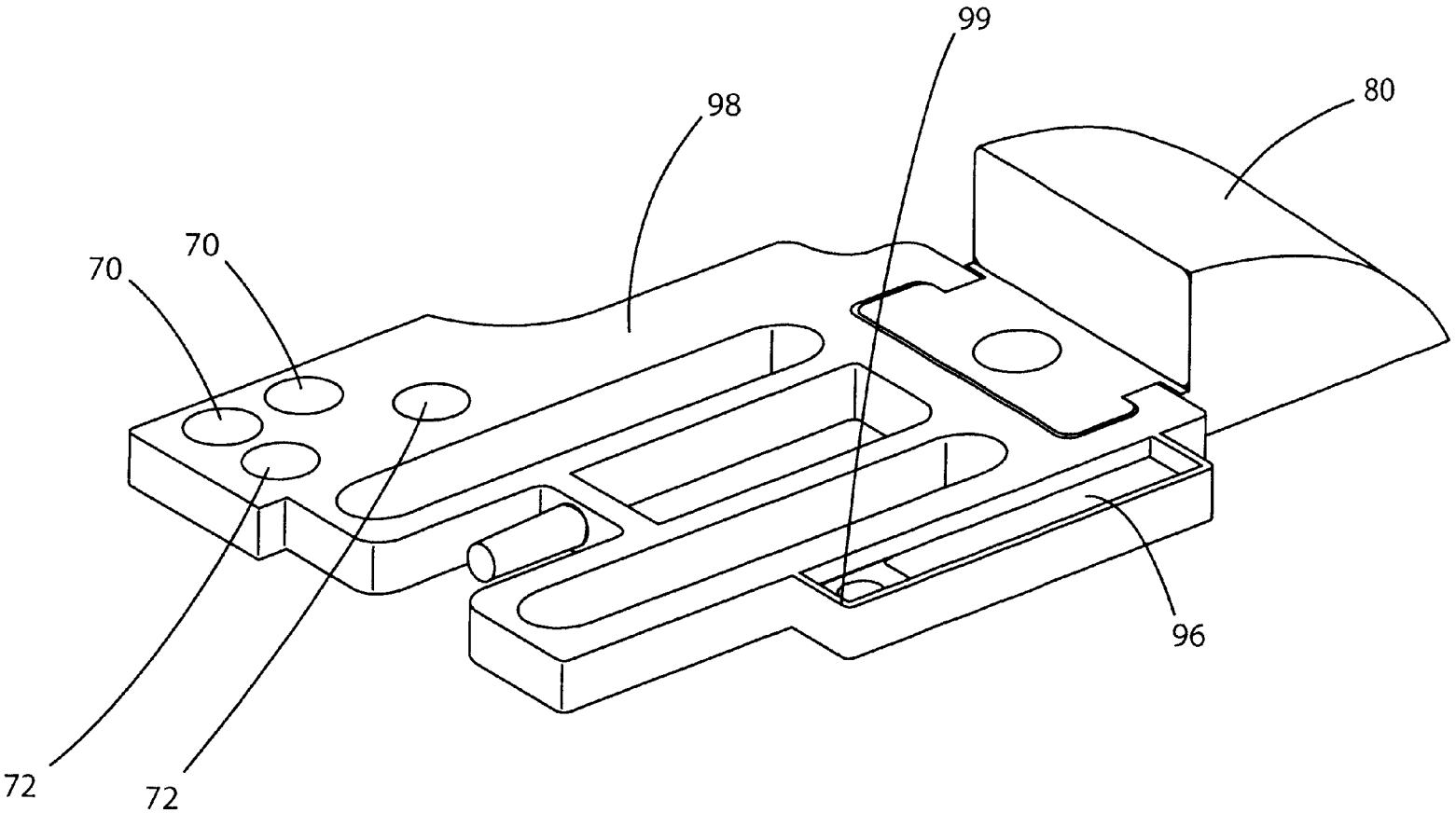
FIG. 13A is an isometric view of the screw drive systems bolt carrier unit used with a spring latch.

FIGS. 13 and 13A show in detail the carrier plate 98 which is attached to a bolt 52 in FIG. 13 and is attached to a spring latch 80 in FIG. 13A. The carrier 98 can be the same as in FIGS. 12–12C. In the case of a bolt operation the travel nut 95 shown in FIG. 12 is attached to the bolt carrier 98 through the hole 100 of the track 96. The travel of the travel nut as result of the continuous screw 93 of the screw drive moves the carrier unit 98 which is attached to the bolt 52, accomplishing the protrusion and retraction motions of the lock unit. In the case of spring latch operation the screw or fastener 94 is removed and the carrier plate 98 is biased forward by a spring 97 (shown in FIG. 14). The carrier plate 98 is retracted by the travel nut 95 which pulls against the back wall 99 of the track 96 when riding on the continuous screw 93. The screw 93 itself is above the track 96. This track arrangement allows for back travel of the latch and carrier 98 when the door is closed with the latch partly or fully extended.

Figure 14:
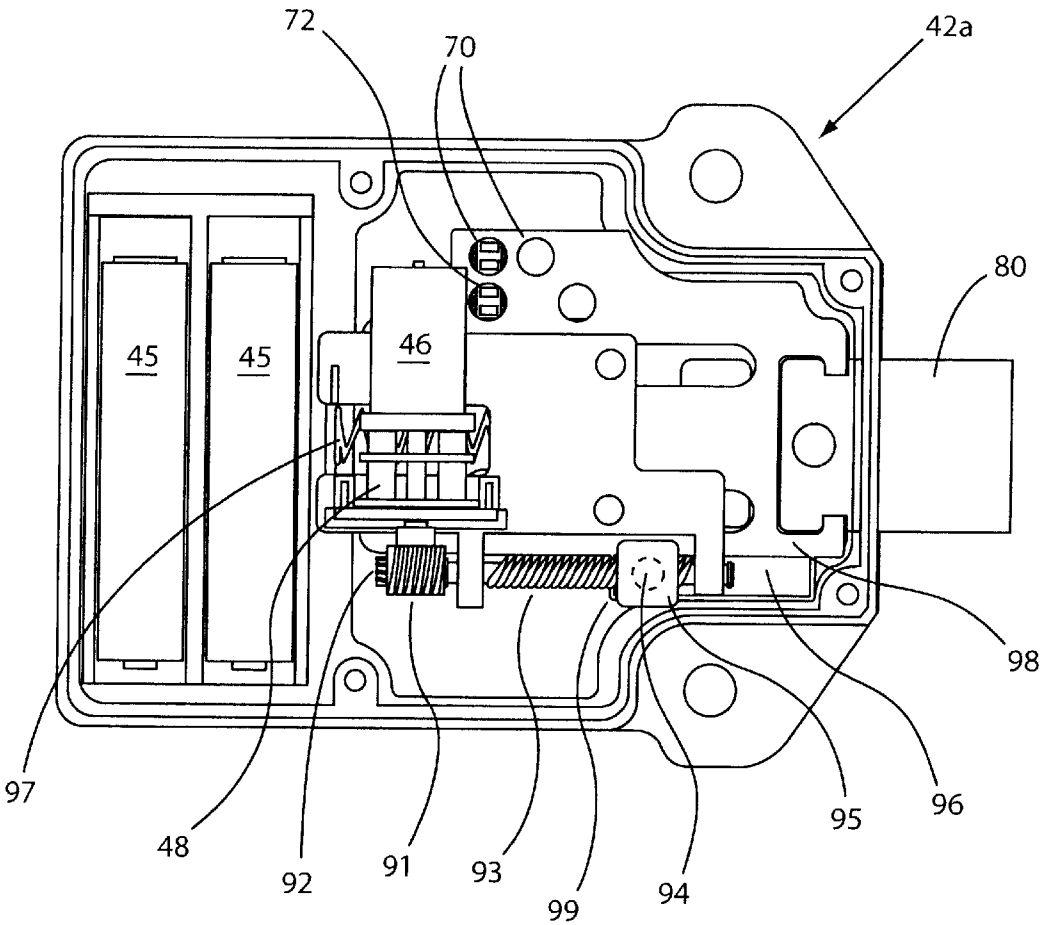
FIG. 14 is an elevation view showing the interior of an electronic locking device utilizing the screw drive mechanism with a spring latch unit of the invention.

FIG. 14 is plan or elevation view illustrating the lock device of the invention with a spring latch as in FIG. 13A rather than a bolt.

FIGS. 13 and 13A show that the lock unit 42*a* can include rows of "windows" 70 and 72 as earlier described, with sensors as shown to allow the full retracted position and full extended position to be adjusted by programming as desired.

Again, as in the bolt embodiment, the lock unit 42*a* has provision for replaceable latches 80, so that a latch of proper length can be selected to accommodate different situations of doors. As apparent from these figures, a latch unit can be converted into a bolt unit, and vice versa. The latch or bolt 80 or 52 is replaced with the other. When converting to bolt, the spring 97 and screw 94 are removed. Thus, the locks of the invention are even more universal in application.

As noted above, the invention also encompasses the provision of the lock units of U.S. Pat. Nos. 5,886,644 and 5,894,277 (assigned to the assignee of this invention and incorporated herein by reference) with an improved drive system, i.e., the DC geared micromotor shown herein, in the context of those disclosed lock units which are fitted to a standard three-hole locker door prep. The use of the micromotor increases the efficiency of the disclosed lock assemblies and enables provision for adjustable bolt travel if desired, whereas this cannot be accomplished with solenoid retraction. One of the areas in which the micromotors efficiency is most apparent is its use in the spring latch models wherein the lock does not need to be continuously powered while keeping the latch retracted. The micromotor is powered until the latch is retracted and powered again when the latch needs to be extended but not in the duration of the time while the latch needs to stay retracted to allow for someone to pull and open the door. This is particularly important in the case of an operation for people with disabilities who may need longer time to pull the door.

The devices of the invention can include several other features. One feature, well known in lockers for health clubs or similar situations where keyed lockers were used, is the requirement of an enabler card to be inserted into the lock before the lock will be operational, i.e., before a day user can actually lock the lock. Typically, this was done with a membership card having a hole at a certain location in the card, the card being inserted by the user in a slot in the lock, on the inside of the locker door, the lock then being enabled. Such provision can also be included in the locker locks of the invention.

Another feature preferably incorporated in the locks of the invention is automatic "handing" of the electronic lock. Since different locker doors can open from the left or the right, the inner housing has two different positions relative to the outer housing to accommodate these two situations (i.e. one position of the inner housing is inverted). In U.S. Pat. Nos. 5,894,277 and 5,886,644, this was accommodated electrically via duplication of pin connectors in the pin connection arrangement extending through the locker door. However, with more functionalities there may not be a sufficient number of pins to accommodate this duplication and automatic opposite-handedness. Thus, in the lock devices of the invention, the motor driver of the microprocessor is programmed to determine the left-hand or right-hand nature of the lock by running through a routine when the lock is first installed. The motor is activated to move the bolt or latch, and the sensors are read to determine the sequence of events and thus to determine the direction of the movement and the handedness of the lock. The microprocessor then sets itself up to operate the lock in the correct manner.

Another feature preferably included is the ability to set the extended position and the retracted position of the adjustable throw bolt or latch via the keypad. Instructions for specific combinations are given to the owner or manager of the lockers, and this adjustable feature can be used at the site rather than being preprogrammed by the manufacturer. If the units have no keypad but use an ibutton as an electronic access device (or proximity device, infrared, transponder, etc. as noted above), the manager is provided with a series of different programming keys, one for each possible desired setting.

Still another feature is provision for adjustment of the retracted time duration in spring latch units by programming using the keypad or ibutton, proximity device, etc. This is particularly important for lockers which may be used by people with disabilities, so that the manager can select and implement a prescribed duration of latch retraction, enabling the disabled person to open the door prior to re-extension of the latch.

The devices described above include the feature that different bolts or latches can be substituted for different situations, by a simple replacement. It should be noted that this can include not only bolts or latches of different lengths, but also different thicknesses and heights or other shape features that may be relevant for certain situations. For example, the strike plate may be of different heights and depths requiring different bolt or latch configurations.

Another important feature preferably included in the devices of the invention addresses the problem of lost combination retrieval. For example, if the manager's combination for the keypad is improperly programmed, and a lock is otherwise inaccessible by anyone at the facility, the manager can enter a prescribed combination which will have been provided by the manufacturer. When this combination is entered into the keypad, the microprocessor will cause the lock to beep out an audible blind code. This audible code can then be communicated to the manufacturer, and the manufacturer will inform the manager as to the code with which the lock was programmed. In all cases, the microprocessor stores the code which was used to lock the lock. If the lock was in active use, two codes would be stored, the last-entered user code and the manager's code. The special combination could be entered by the manager in the case of a lost combination which will cause the microprocessor to issue the blind code, representing the manager's code, in audible form. This is then used to obtain the unlocking code via the manufacturer.

Another feature which may be included is a counter feature by which each unit stores the number of times it has been locked. This might be advantageous in determining the useful life of the lock and its various components.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

What is claimed is:

1. In combination with a locker for temporary storage of a user's articles, the locker having a door and a movable bolt or latch positioned to secure the door when in extended position and to unlock the door when moved to a retracted position, an electronic lock for controlling the bolt or latch, comprising:

an inner housing and an outer housing, the inner housing being secured at the inside of the door and the outer housing being secured at a directly opposed position on the outside of the door such that the door is sandwiched between the two housings, with an electrical connection connecting the inner housing to the outer housing, through an opening in the door, electronic access means in the outer housing, for receiving an access code input by a user, an electrically operated drive mechanism connected to the bolt or latch so as to control the position of the bolt or latch, microcontroller means connected between the electronic access means and the electrically operated drive mechanism, for changing the position of the bolt or latch when a preselected access code is received by the electronic access means, a battery in one of the housings, connected to supply power to the electronic lock, and the inner housing further including an enabler card slot for receipt of a user's non-unique enabler card, and wherein the microprocessor requires insertion of a enabler card prior to enabling the lock to be locked by the user.

2. A lock unit, comprising:

a housing, a bolt or latch connected to the housing and slidable between extended and retracted positions, an electrically operated drive mechanism connected to the bolt or latch in the housing, a source of power for the electrically operated drive mechanism, control means for connecting power to the electrically operated drive mechanism when the lock unit is properly accessed, to retract the bolt or latch to a retracted position, and for extending the bolt or latch to an extended bolt position, when the unit is to be in a locked mode, and a lock accessing device connected to the control means and at a front of the lock unit, including a keypad for input of a code to set or to access the lock, and the front of the lock unit further including a key reader receptacle for receiving an identification device as an alternate means for accessing the lock.

3. A lock unit, comprising:

a housing, a bolt connected to the housing and slidable between extended and retracted positions, an electrically operated drive mechanism connected to the bolt or latch in the housing, a source of power for the electrically operated drive mechanism, control means for connecting power to the electrically operated drive mechanism when the lock unit is properly accessed, to retract the bolt or latch to a retracted position, and for extending the bolt or latch to an extended bolt position, when the unit is to be in a locked mode, and a lock accessing device connected to the control means and at a front of the lock unit, including a keypad for input of a code to set or to access the lock, and further including a microprocessor and tone generating means for emitting an audible blind code representing a stored manager code for the lock, whereby a manager whose combination has been lost can note the audible blind code, and communicate it to the manufacturer, to obtain a code to open the lock.

4. In combination with a locker for temporary storage of a user's articles, the locker having a door and a movable bolt or latch positioned to secure the door when in extended position and to unlock the door when moved to a retracted position, an electronic lock for controlling the bolt or latch, comprising:

an inner housing and an outer housing, the inner housing being secured at the inside of the door and the outer housing being secured at a directly opposed position on the outside of the door such that the door is sandwiched between the two housings, with an electrical connection connecting the inner housing to the outer housing, through an opening in the door, electronic access means in the outer housing, for receiving an access code input by a user, including a keypad for input of a code to set or to access the lock, and further including a key reader receptacle for receiving an identification device as an alternate means for accessing the lock, an electrically operated drive mechanism connected to the bolt or latch so as to control the position of the bolt or latch, microcontroller means connected between the electronic access means and the electrically operated drive mechanism, for changing the position of the bolt or latch when a preselected access code is received by the electronic access means, and a battery in one of the housings, connected to supply power to the electronic lock.

* * * * *

Disclaimer

6,655,180 B2 — Asil T. Gokcbay, Petaluma, CA (US); Yucel K. Keskin, San Clara, CA (US); and Robert Kearns, Santa Clara, CA (US). LOCKER LOCK WITH ADJUSTABLE BOLT. Patent dated December 2, 2003. Disclaimer filed July 21, 2015, by the assignee, Security People, Inc.

Hereby disclaims the complete claims 1 and 2 of said patent.

*(Official Gazette, August 25, 2015)*